US006542784B1

(12) United States Patent
Amaya et al.

(10) Patent No.: US 6,542,784 B1
(45) Date of Patent: Apr. 1, 2003

(54) PLATING ANALYSIS METHOD

(75) Inventors: Kenji Amaya, Kawasaki (JP); Shigeru Aoki, Yokohama (JP); Matsuho Miyasaka, Yokohama (JP)

(73) Assignee: Ebara Corporation, Tokyo (JP)

( * ) Notice: Subject to any disclaimer, the term of this patent is extended or adjusted under 35 U.S.C. 154(b) by 328 days.

(21) Appl. No.: 09/714,211

(22) Filed: Nov. 17, 2000

(30) Foreign Application Priority Data

Nov. 19, 1999 (JP) ..... 11-330159

(51) Int. Cl.[7] ..... G06F 19/00; C25D 21/12; C25D 5/00; C23F 13/00

(52) U.S. Cl. ..... 700/121; 205/81; 205/82; 205/83; 205/84; 205/96; 205/97; 205/724

(58) Field of Search ..... 205/81–84, 96, 205/97, 724; 700/121

(56) References Cited

U.S. PATENT DOCUMENTS 4,100,036 A * 7/1978 Rode et al. ..... 205/83
6,162,344 A * 12/2000 Reid et al. ..... 205/157

OTHER PUBLICATIONS

Allan H. Reed, "Optimization of Wafer Plating Cell Design Using Finite Difference Calculations", Proceeding. AESF SUR/FIN Annual International Technical Conference, pp. 137–141, 1999.

Katsuhiko Ohara et al., "Current distribution simulation by FEM and film thickness distribution of various plating solutions in the Hull Cell test", Proceedings of Surface Finishing Society of Japan, 82$^{nd}$, pp. 57–58, 1990.

Shigeru Mori et al., "Improvement of the Pulse–plated Film Leveling", Transactions of the Society of Chemical Engineers, Japan/ vol. 22 No. 4, pp. 786–793, 1996.

* cited by examiner

*Primary Examiner*—Leo Picard
*Assistant Examiner*—Ryan Jarrett
(74) *Attorney, Agent, or Firm*—Wenderoth, Lind & Ponack, L.L.P.

(57) ABSTRACT

A plating analysis method is disclosed for electroplating in a system in which resistance of an anode and/or a cathode cannot be neglected. This method comprises giving a three-dimensional Laplace's equation, as a dominant equation, to a region containing a plating solution; discretizing the Laplace's equation by the boundary element method; giving a two-dimensional or three-dimensional Poisson's equation dealing with a flat surface or a curved surface, as a dominant equation, to a region within the anode and/or the cathode; discretizing the Poisson's equation by the boundary element method or the finite element method; and formulating a simultaneous equation of the discretized equations to calculate a current density distribution i and a potential distribution $\phi$ in the system. The method can obtain the current density and potential distributions efficiently for a plating problem requiring consideration for the resistance of an electrode. The method also optimizes the structure of a plating bath for uniformizing current, which tends to be concentrated in the outer peripheral portion of the cathode, thereby making the plating rate uniform.

9 Claims, 7 Drawing Sheets

PLATING ANALYSIS METHOD

BACKGROUND OF THE INVENTION

1. Field of the Invention

The present invention relates to a computer-assisted analysis method for predicting the growth rate distribution of a plated film in electroplating to obtain a uniform plating thickness distribution. More particularly, the invention relates to a method preferred for analysis of the plating rate distribution of a metal intended for wiring on a semiconductor wafer.

2. Description of the Related Art

In a system in which an anode and a cathode constitute a cell via an electrolyte and form a potential field in the electrolyte, a potential distribution and a current density distribution are important for such a problem as a plating or corrosion problem. To predict these distributions in the system, computer-assisted numerical analysis by the boundary element method, the finite element method, or the finite difference method has been attempted. This analysis is conducted based on the facts that the potential in the electrolyte is dominated by Laplace's equation; that the potential and current density on the anode surface and the cathode surface are ruled by an electrochemical characteristic, called a polarization curve (nonlinear functions found experimentally for showing the relationship between potential and current density), determined by a reaction caused when the anode and the cathode are disposed in the electrolyte; and that the current density is expressed as the product of a potential gradient and the electrical conductivity of the electrolyte.

In electroplating, the plating rate of a metal deposited on the cathode can be calculated from the analyzed current density of the cathode by Farady's law. Thus, the above-mentioned numerical analysis enables the plating rate distribution to be predicted beforehand according to the conditions, such as the structure of a plating bath, the type of a plating solution, and the types of materials for the anode and the cathode. This makes it possible to design the plating bath rationally.

In recent years, it has been attempted to utilize electroplated copper for wiring in a semiconductor integrated circuit. In this case, as shown in FIG. 1A, fine grooves 2 are formed by etching in a surface of an interlayer insulator film 1 of $SiO_2$ or the like on a semiconductor wafer W. Copper, a material for wiring, is buried in the grooves 2 by electroplating. To prevent mutual diffusion between the copper and the SiO2 film, a barrier layer 3 of TaN or the like is formed beforehand on the surface of the $SiO_2$ film by a method such as sputtering. Since $SiO_2$ and TaN are insulators or high resistance materials, a thin film (called a seed layer) 4 of copper, which acts as a conductor and an electrode for electroplating, is formed on the TaN by a method such as sputtering.

The seed layer 4 of copper formed beforehand is as thin as about several tens of nanometers in thickness. While a current is flowing through this thin copper seed layer, a potential gradient occurs in this seed layer because of its resistance. If plating is carried out with a layout as shown in FIG. 1A, a nonuniform thickness of plating, i.e., thick on the outer periphery and thin on the inner periphery, arises as shown by a solid line 5 in the drawing, since a current flows more easily nearer to the outer peripheral region. As shown in FIG. 1B, moreover, when a metal such as copper is buried in fine holes or fine grooves by plating, a potential gradient appears in the copper seed layer because of the resistance of the seed layer. As a result, the plating rate increases near the entrance of the hole or groove, and defects, such as portions void of copper, occur in the hole or groove. An additive for suppressing the reaction is used to bring down the preferential growth rate of a plating in the vicinity of the groove, thereby preventing the occurrence of internal defects.

Many conventional methods of plating analysis are based on the concept that a potential gradient occurs only in an electrolyte, and the resistances of an anode and a cathode are so low as to be negligible. In analyzing the current density distribution and the voltage distribution of electroplating on a semiconductor wafer, however, the resistance on the electrode side cannot be neglected, and needs to be considered.

An example of a plating analysis method taking the electrode-side resistance into consideration has been attempted by the finite element method. According to this method, the interior of a plating solution region is divided into elements. Resistance conditions for the plating solution are put into these elements, and the electrode with resistance is divided into elements as deposition elements. Resistance conditions for the electrode are put into these elements. Furthermore, an element called an overvoltage element is newly created at a position, on the surface of the electrode (mainly cathode), in contact with the plating solution. In this element, the conditions for polarization resistance of the electrode are placed. The entire element is regarded as a single region, and analyzed by the finite element method. The deposition elements correspond to a plated film. The thickness of the plated film at the start of plating is zero. Then, the film thickness determined by the current density calculated at elapsed time points is accumulated, and the values found are handled as the thickness.

A suitable structure of the plating bath and a suitable arrangement of electrodes are devised by numerical calculation or based on a rule of thumb. To make the plating rate uniform, placement of a shield plate in the plating solution for avoiding concentration of a current in the outer peripheral portion, for example, has been proposed and attempted. However, a sufficient effect has not been obtained. Nor has any rational method concerning a design of the shield plate been established up to now.

It is generally pointed out that the boundary element method requiring no element division of the interior is advantageous in analyzing problems (such as plating, corrosion and corrosion prevention problems) for which a potential distribution and a current density distribution on the surface of a material are important. The boundary element method is applied to the analysis of a plating problem requiring no consideration for the resistance of an electrode, and its effectiveness has already been confirmed. However, it has not been known that the boundary element method can be applied for a plating problem requiring consideration for the resistance of an electrode.

As described above, the finite element method has been applied to a plating problem requiring consideration for the resistance of an electrode. However, the finite element method requires the division of the interior into elements, thus involving a vast number of elements. Consequently, this method takes a long time for element division and analysis.

SUMMARY OF THE INVENTION

The present invention has been accomplished under these circumstances. An object of the invention is to provide a plating analysis method which can obtain a current density distribution and a potential distribution efficiently for a plating problem requiring consideration for the resistance of an electrode. Another object of the invention is to provide a plating analysis method for optimizing the structure of a plating bath designed to uniformize a current, which tends to be concentrated near an outer peripheral portion of a cathode, thereby making the plating rate uniform.

A first aspect of the present invention is a plating analysis method for electroplating in a system. The method comprises: giving a three-dimensional Laplace's equation, as a dominant equation, to a region containing a plating solution between an anode and a cathode; discretizing the Laplace's equation by a boundary element method; giving a two-dimensional or three-dimensional Poisson's equation dealing with a flat surface or a curved surface, as a dominant equation, to a region within the anode and/or the cathode; discretizing the Poisson's equation by the boundary element method or a finite element method; and formulating a simultaneous equation of the discretized equations to calculate a current density distribution and a potential distribution in the system.

According to this aspect, the Poisson's equation is given to the region within the anode and/or the cathode in consideration of the resistance of the anode and/or the cathode. This ensures consistency with the region within the plating solution to be dominated by the three-dimensional Laplace's equation. Thus, while the influence of the resistance of the anode and/or cathode is considered, the element division of the region within the plating solution is not necessary, so that the time required for element division and analysis can be markedly shortened. This aspect, therefore, enables accurate and efficient simulation of the current density distribution and the potential distribution within the plating bath that takes the influence of the resistance of the anode and/or the cathode into consideration.

The plating analysis method may further comprise giving the electrical conductivity or resistance of the anode and/or the cathode, as a function of time, to the region within the anode and/or the cathode. Thus, even if the resistance value distribution of the cathode, a semiconductor wafer as an object to be plated, changes because of deposition of a plated film on the cathode with the passage of time, it becomes possible to simulate the state of the change in the distribution.

The plating analysis method may further comprise: dividing the anode into two or more divisional anodes; and calculating such optimum values of current flowing through the divisional anodes as to uniformize a current density distribution on the surface of the cathode, thereby uniformizing the plating rate. This makes it possible to simulate the structure of the plating bath, the shape of the divisional anode, and the method for current supply that will apply a uniformly thick plated film onto the entire surface of a semiconductor wafer.

The plating analysis method may further comprise: calculating and giving the optimum values of current flowing through the divisional anodes at time intervals, thereby uniformizing the plating rate. Thus, simulation can be performed so that even when a thick plated film is applied over time, a uniform current density distribution is obtained on the entire surface of the wafer to obtain a uniform plated film thickness.

A second aspect of the invention is a plating apparatus produced with the use of any one of the plating analysis methods described above.

In the plating apparatus, the position, shape, and size of the anode and/or the position, shape and size of a shield plate may have been adjusted so that the current density distribution on the cathode surface will be uniformized by use of any one of the above plating analysis methods.

A third aspect of the invention is a plating method comprising: applying a metal plating by use of any one of the plating analysis methods described above, the metal plating being intended for formation of wiring on a wafer for production of a semiconductor device.

A fourth aspect of the invention is a method for producing a wafer for a semiconductor device, comprising: applying plating to the wafer by the plating method described above; and polishing the surface of the wafer by chemical and mechanical polishing (CMP) to produce the wafer of a desired wiring structure.

A fifth aspect of the invention is a method for analysis of corrosion and corrosion prevention in a system. The method comprises: giving a three-dimensional Laplace's equation, as a dominant equation, to a region containing an electrolyte; discretizing the Laplace's equation by a boundary element method; giving a two-dimensional or three-dimensional Poisson's equation dealing with a flat surface or a curved surface, as a dominant equation, to a region within the anode and/or the cathode; discretizing the Poisson's equation by the boundary element method or a finite element method; and formulating a simultaneous equation of the discretized equations to calculate a current density distribution and a potential distribution in the system.

This aspect enables the present invention to be used for analysis of corrosion and corrosion prevention.

To sum up the effects of the invention, the finite element method has been the only feasible method for numerical analysis of the plating rate distribution in electroplating of a system in which the resistance of an anode and/or a cathode is not negligible. However, when dividing the regions of the plating bath into elements, even the interior region needs to be divided, thus taking a vast amount of time for element division and analysis.

The methods of the present invention employing the boundary element method do not require element division within a plating solution, and thus can markedly shorten the time for element division and analysis. Moreover, when the shape of the plating bath is axially symmetrical and can be modeled, the region accounted for by the solution can be divided into axially symmetrical elements. Thus, more efficient analysis can be performed.

In connection with electroplating in a system in which the resistance of a cathode is not negligible, there has been a demand for a method, which can correct non uniformity of the plating rate due to the presence of resistance of the cathode. To satisfy this demand, the invention provides methods, which comprise dividing an anode suitably, and calculating optimal values of current to be flowed through the divisional anodes. These methods can uniformize the current, which tends to be concentrated in the peripheral portion of the cathode, by a short time of analysis.

The above and other objects, features, and advantages of the present invention will be apparent from the following description when taken in conjunction with the accompanying drawings, which illustrates preferred embodiments of the present invention by way of example.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Embodiments of the present invention will now be described in detail with reference to the accompanying drawings. An example of copper plating for installing copper wiring on a wafer will be mentioned. A barrier layer of TaN or the like and a Cu seed layer formed beforehand on an interlayer insulator film on a wafer surface are handled as a cathode with resistance. Usually, a copper plate for use as an anode, which is a plating source, has a sufficient thickness, and so its resistance is neglected. The cathode has tiny irregularities, but the wafer surface is regarded as a surface without irregularities from a macroscopic viewpoint, on the premise that a macroscopic plating rate on the wafer surface will be found. Current density and electrical conductivity within the cathode are given as average values of respective elements, with the wafer surface being regarded as a flat surface. When plating is started, the thickness of the cathode varies with the passage of time. The non uniformity of the plating rate is governed by the non uniformity of the initial (at zero time) current density. Thus, the initial current density distribution is found by this analysis.

Generally, the initial (zero time) resistance of the cathode is often uniform. In this case, discretization of the Poisson's equation, a dominant equation for the cathode, is performed by the boundary element method. If the initial (zero time) resistance of the cathode is nonuniform, discretization of the Poisson's equation is performed by the finite element method, and different resistance values are given as boundary conditions to the respective elements. Even when the resistance of the cathode is uniform, discretization of the Poisson's equation is performed similarly by the finite element method, if the cathode is a curved surface. In the descriptions to follow, an anode is handled as a thick copper plate with its electrical resistance being neglected. If its resistance cannot be neglected, analysis can be made by handling the anode in the same manner as the cathode.

Figure 2:
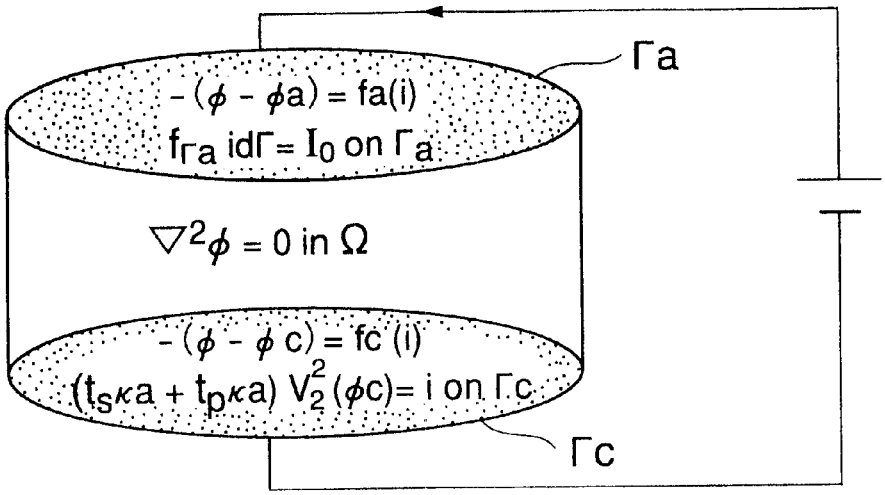
FIG. 2 is a view for explaining boundary conditions for finding a potential distribution and a current density distribution.

As shown in FIG. 2, let a region which a solution in a plating bath occupies be $\Omega$, and the potential in $\Omega$ be $\phi$. With an ordinary electrochemical problem, a potential E relative to a certain reference electrode is used. In the present embodiment, on the other hand, the potential of any given point in the solution relative to a certain reference point within the cathode is taken as $\phi$. The potentials of arbitrary points within the anode and the cathode relative to the reference point are designated as $\phi a$ and $\phi c$. Except at sites very close to the metal (anode and cathode) surfaces, $\phi$ satisfies the following Laplace's equation in $\Omega$:

$$\nabla^2\phi=0 \tag{1}$$

A complicated behavior at a site very near the metal surface is incorporated into a polarization curve as a potential gap on the metal surface between the metal and the solution, and handled as a boundary condition. Even if many narrow grooves for electrode wiring exist on the metal surface, the geometrical shape of the groove is not considered, and a macroscopic (including the influences of the groove comprehensively) polarization curve is measured, and it is used as a boundary condition.

Accordingly, the boundary conditions for the above equation are given by the following equations:

$$\phi=\phi_o \text{ on } \Gamma_d \tag{2}$$

$$i(\equiv\kappa\partial\phi/\partial n)=i_o \text{ on } \Gamma_n \tag{3}$$

$$-(\phi-\phi_a)=f_a(i) \text{ on } \Gamma_a \tag{4}$$

$$-(\phi-\phi_c)=f_c(i) \text{ on } \Gamma_c \tag{5}$$

In connection with the above equations, $\Omega$ is surrounded by $\Gamma_d+\Gamma_n+\Gamma_a+\Gamma_c$ ($\equiv\Gamma$), $\Gamma_d$ and $\Gamma_n$ denote, respectively, boundaries for which potential $\phi$ and current density i have been designated ($\phi_o$ and $i_o$ are designated values), while $\Gamma_a$ and $\Gamma_c$ denote an anode surface and a cathode surface, respectively. $\kappa$ denotes the electrical conductivity of the solution. $\partial/\partial$ n denotes an outward normal direction, with the value of a current flowing into the solution through the surface of the object being set to be positive $f_a(i)$ and $f_c(i)$ denote, respectively, generally nonlinear functions representing macroscopic polarization curves of the anode and the cathode, and they are obtained experimentally.

Since the anode is a thick copper plate, its electrical resistance can be neglected, so that the potential $\phi_a$ within the anode can be assumed to be constant. However, if the value of current, $I_o$, supplied to the anode is designated, the following equation needs to be supplemented for Equation (4), since the value of $\phi_a$ is unknown:

$$\int_{\Gamma_a} i\,d\Gamma = I_0 \tag{6}$$

If a plurality of anodes are used, the potential in each of the anodes is assumed to be constant, and an equation corresponding to the above equation is used for each anode.

In an actual process, a thin barrier layer of tantalum nitride (TaN) and a thin Cu seed layer are formed on an $SiO_2$ insulator film on the surface of a silicon wafer by a method such as sputtering. Then, a copper plating is applied onto these layers. During this process, the electrical resistance in the cathode, i.e., the barrier layer and the seed layer, is not negligible. Thus, the potential $\phi_c$ of the cathode depends on the current density in the cathode $$i_c=(i_{cx}, i_{cy})$$

where $i_{cx}$ and $i_{cy}$ denote an x-direction component and a y-direction component, respectively, of the current density $i_c$, with an orthogonal coordinate system 0-xy having an x-axis and a y-axis on the silicon wafer being used.

The surface of the silicon wafer is regarded macroscopically as a flat surface, even if many narrow grooves are present. The current density and electrical conductivity (or film thickness) within the cathode are given as macroscopic (equivalent when the surface is regarded as a flat surface) values. Thus, the current density $i_c$ [A/m$^2$] in the cathode is defined as follows:

$$i_c=-(t_s\kappa_s+t_p\kappa_p)\nabla_2(\phi_c) \tag{7}$$

where $t_s$ and $\kappa_s$ denote, respectively, the thickness [m] and the electrical conductivity [$\Omega^{-1}m^{-1}$] of the TaN barrier layer; and $t_p$ and $\kappa_p$ denote, respectively, the thickness [m] and the electrical conductivity [$\Omega^{-1}m^{-1}$] of the Cu seed layer. The subscript 2 to $\nabla$ signifies a two-dimensional (in the x-y plane) operator. Since the $SiO_2$ insulator film has high electrical resistance, the current density in it is assumed to be negligible.

Provided that a current (−i) flows from the solution into the surface of the cathode, the following equation is obtained by the principle of conservation of charge in a fine region within the cathode:

$$div_2(i_c)+i=0 \tag{8}$$

From Equations (7) and (8), the following equation becomes a dominant equation for the interior of the cathode:

$$(t_sk_s+t_p\kappa_p)\nabla^2{}_2(\phi_c)=i \tag{9}$$

The plating rate is proportional to the current (i) on the cathode surface. Thus, Equations (1) to (5) and (6) and (9)are simultaneously solved for i, whereby knowledge of the distribution shape of the plating rate can be obtained.

A boundary condition integral equation for Equation (1) is $$\kappa c(y)\phi(y) = \int_\Gamma \phi^*(x, y)\, i(x)d\Gamma - \int_\Gamma i^*(x, y)\, \phi(x)d\Gamma \tag{10}$$

Where x and y denote position vectors of an observation point and a source point, respectively, and fundamental solutions f* and i* are given by $$\phi^*(x,y)=¼\pi r \tag{11}$$

$$i^*(x,y)=\kappa\partial\phi^*(x,y)/\partial n \tag{12}$$

Here, $$r=|r|=|x-y|$$

and n denotes a boundary outward unit normal vector at the observation point x.

Substituting the boundary conditions (2) and (3) into Equation (10) for discretization gives the following equation:

$$[H]\{\phi\}=[G]\{i\} \tag{13}$$

where [H] and [G] are known matrices dependent on the shapes of the element and Γ, while {ϕ} and {i} are vectors having the values of ϕ and i at the respective nodal points as components. This equation, if unchanged, cannot be solved, because $\phi_a$ in the boundary condition (4) and $\phi_c$ in Equation (5) are unknown. Thus, the boundary condition on the anode surface is considered. Discretization of Equations (4) and (6) gives the following two equations:

$$\{\phi\}_a=\{\phi_a\}_a+\{-f_a(i)\}_a \tag{14}$$

$$\{A\}^T{}_a\{i\}_a=I_o \tag{15}$$

where $\{\ \}_a$ denotes a vector having a value on a nodal point on the anode surface ($\Gamma_a$) as a component, A denotes an element area, and $\{\ \}^T$ denotes a transposition. (For simplification, the equations for constant elements have been shown, but discretization can be performed easily for general elements.) Attention should be paid to the facts that the components of $\{\phi_a\}_a$ take the same constant value $\phi_a$, and that $\{i\}_a$ is a part of {i} in Equation (13).

Next, the boundary conditions for the cathode surface will be discussed. A boundary integral equation for Equation (9)is:

$$c(t_s\kappa_s + t_p\kappa_p)\phi_c(y) = \int_\Gamma \{\phi_2^*(x, y)\, i_c(x) - i_x^*(x, y)\phi_x(x)\}d\gamma + \int_\Gamma \phi_2^*(x, y)i(x)d\Gamma \tag{16}$$

where γ denotes a curve surrounding the cathode surface Γc, and the non-bold symbol $i_c$ denotes a current density ($\equiv(t_s\kappa_s+t_p\kappa_p)\ \partial\phi_c/\partial n_2$)) flowing from γ, $\partial/\partial n_2$ denoting an outward normal derivative of a two-dimensional problem.

The fundamental solutions $\phi^*{}_2$ and $i^*{}_2$, respectively, to the two-dimensional problem are given by $$\phi_2^*(x, y) = \frac{1}{2\pi}\ln\left(\frac{1}{\gamma}\right) \tag{17}$$

$$i_2^*(x, y) = (t_s\kappa_s + t_p\kappa_p)\frac{\partial\phi_2^*(x, y)}{\partial n_2} \tag{18}$$

Discretization of Equation (15) gives $$[H_2]\{\phi_c\}=[G_2]\{i_c\}+[B_2]\{i\}_c \tag{19}$$

where $[H_2]$, $[G_2]$ and $[B_2]$ are known matrices dependent on γ and the shapes of the element, while $\{\phi_c\}_r$ and $\{i\}_c$ are vectors having the values of $\phi_c$ and $i_c$ at the respective nodal points on γ as components. { } denotes a vector having a value on a nodal point on the cathode surface (Γ) as a component $i_c$ is given in a portion of the boundary γ, and $\phi_c$ is given in other portions. Thus, when i on the cathode surface is given, Equation (19) can be solved. The use of an equation for the inner points obtains a potential distribution on the cathode surface as follows:

$$\{\phi_c\}_c=1/(t_s\kappa_s+t_p\kappa_p)\ [C]\{i\}_c \tag{20}$$

where [C] is a matrix dependent on the positions of the inner points.

This equation and the boundary condition equation (5) give $$\{\phi\}_c=\{-f_c(i)\}_c+1/(t_s\kappa_s+t_p\kappa_p)[C]\{i\}_c \tag{21}$$

Note that $\{i\}_c$ is a part of {i} in Equation (13). Equations (14) and (21) are used as the boundary conditions on the anode surface and the cathode surface, respectively, and iterative calculations as by the Newton-Raphson method are made, whereby a simultaneous equation involving Equations (13) and (15) can be solved. That is, calculations are carried out by the following procedure:

1. Suitably assume $\{i\}_a$, $\phi_a$, $\{i\}_c$ and unknown value of Equation (13) (vector components for i on $\theta_d$ and $\phi$ on $\theta_n$).
2. Substitute the assumed $\{i\}_a$ and $\phi_a$ into Equation (14) to obtain $\{\phi\}_a$, and substitute $\{i\}_c$ into Equation (21) to calculate $\{\phi\}_c$.
3. Substitute the values obtained by the above two steps into Equations (13) and (15), and find the difference between the values of both sides.
4. Revise the values such as $\{i\}_a$, assumed in Step 1, according to the Newton-Raphson method or the like so that the above difference decreases, return to Step 2, and repeat calculations until the difference becomes less than the allowable error.

To verify Equation (20), assume that there is a circular cathode (silicon wafer) with radius R and having $\phi_c=0$ at the outer periphery of the cathode. If a current density from the solution is assumed to be uniform ($i=-i_o$), an analysis solution for the potential $\phi_c$ within the cathode, at a position apart from the center by $\rho$ is found as follows:

$$\phi_c=i_o(R^2-\rho^2)/4(t_s k_s+t_p\kappa_p) \tag{22}$$

Figure 3:
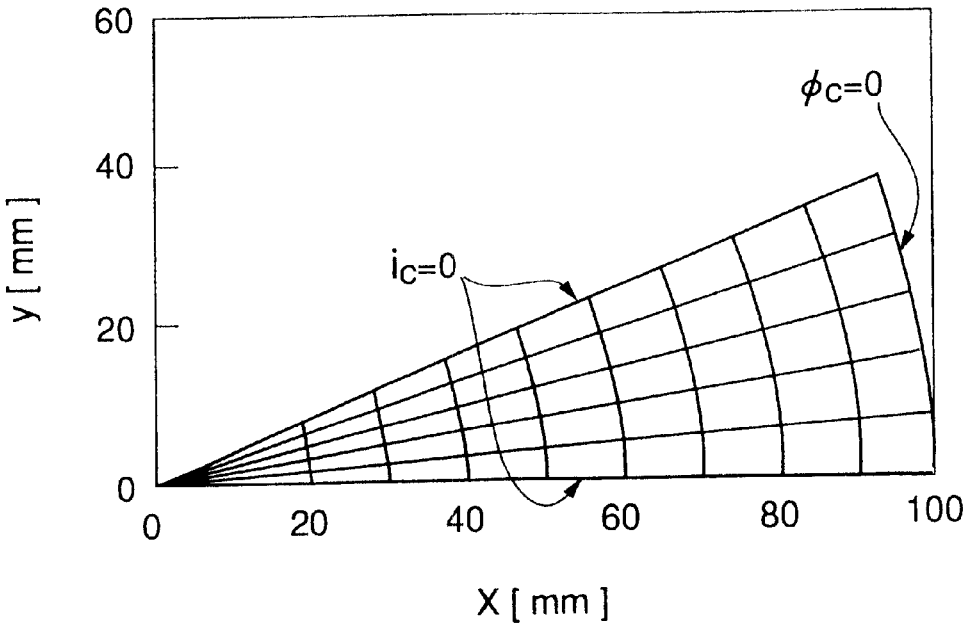
FIG. 3 is a view showing an example of division into boundary elements.

Separately, a two-dimensional boundary element analysis was performed to obtain $\phi_c$ from Equation (20). Analysis was performed of a region, one of 16 segments divided from the cathode by use of symmetry. As shown in FIG. 3, the region was divided into triangular and quadrilateral constant elements, and the boundary conditions shown in the drawing were used. The following values were used for analysis:

R=100 [mm], $i_o$=0.05 [mA/mm$^2$], $t_s$=0.03 [$\mu$m], $\kappa_s$=4.0 $\times10^3$ [$\Omega^{-1}$ mm$^{-1}$], $t_p$=0.1 [$\mu$m], $\kappa_p$=5.0$\times10^4$ [$\Omega^{-1}$ mm$^{-1}$].

Figure 4:
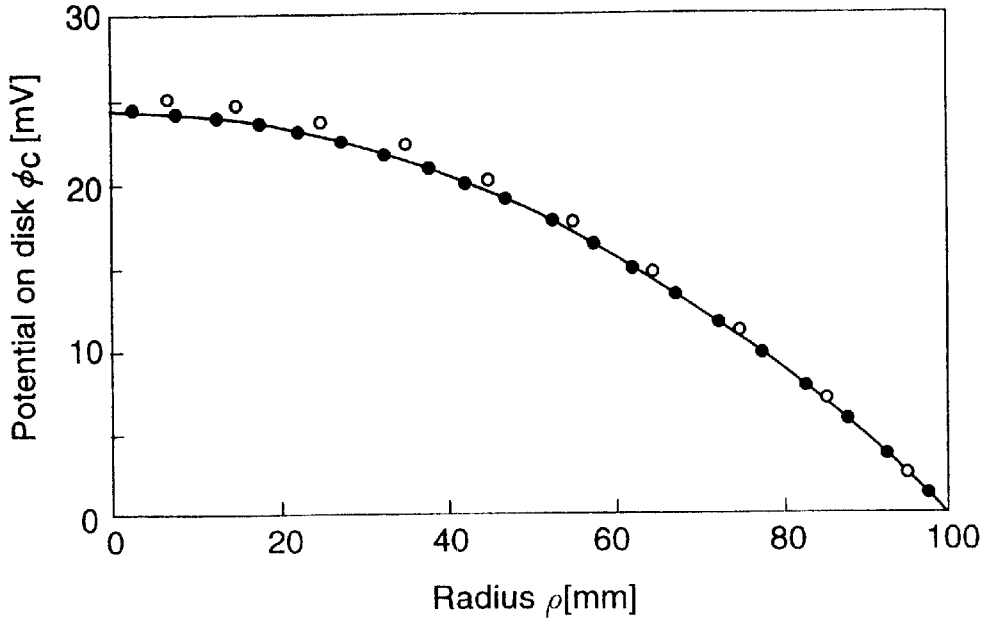
FIG. 4 is a view showing a comparison between boundary element solutions and analysis solutions.

FIG. 4 shows the distribution of potential $\phi_c$ within the cathode. The boundary element solutions by Equation (20) (indicated by open circles in the drawing) are found to agree highly with the analysis solutions by Equation (22) (indicated by a solid line in the drawing).

Figure 5:
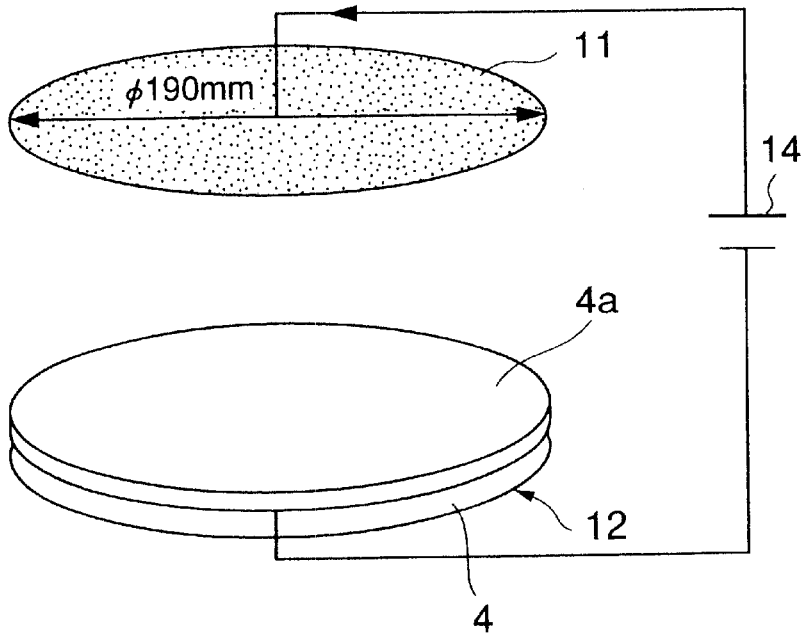
FIG. 5 is a view showing a plating bath, an object to be simulated.

Using the foregoing method, a simulation for applying a copper plating to a silicon wafer was done in a plating bath as shown in FIG. 5. This plating bath was composed of an anode 11 comprising a copper plate, a cathode 12 comprising a wafer to be plated, an electrolyte plating solution 13 present between them, and a power source 14 for passing a current between the anode and the cathode. In this case, the diameter of each of the anode and the cathode was 190 mm, the distance between the anode and the cathode was 10 mm, the thickness of a copper sputter layer 12*a* of the cathode was 0.03 $\mu$m, and the thickness of a plating layer 12*b* was 0.1 $\mu$m. Electrical conductivity $\kappa$ was 0.056/$\Omega$·mm for the electrolyte plating solution 13, 5.0$\times10^4$/$\Omega$·mm for the plating layer 12*b*, and 4.0$\times10^3$/$\Omega$·mm for the sputter layer 12*a*. The current passed was 1.5 A.

Figure 6:
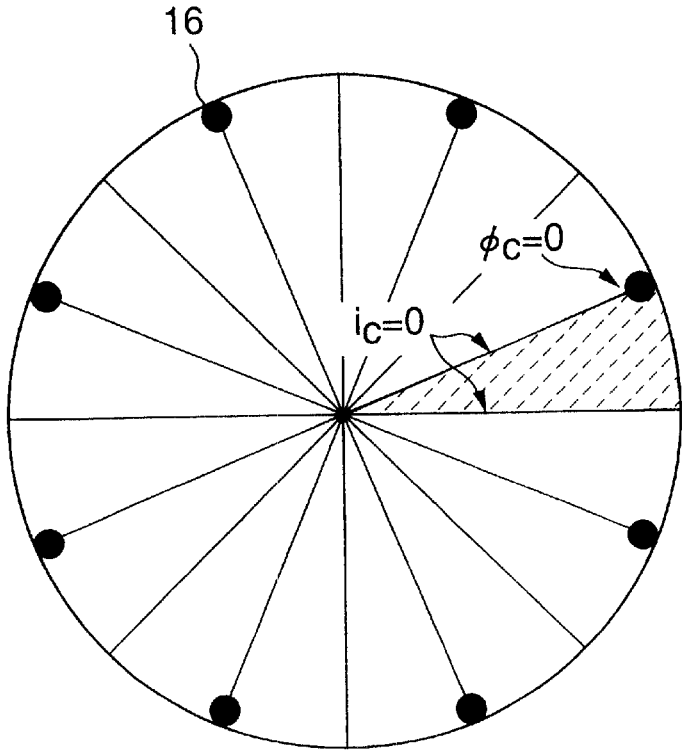
FIG. 6 is a view showing an analytic model of a cathode.
Figure 7:
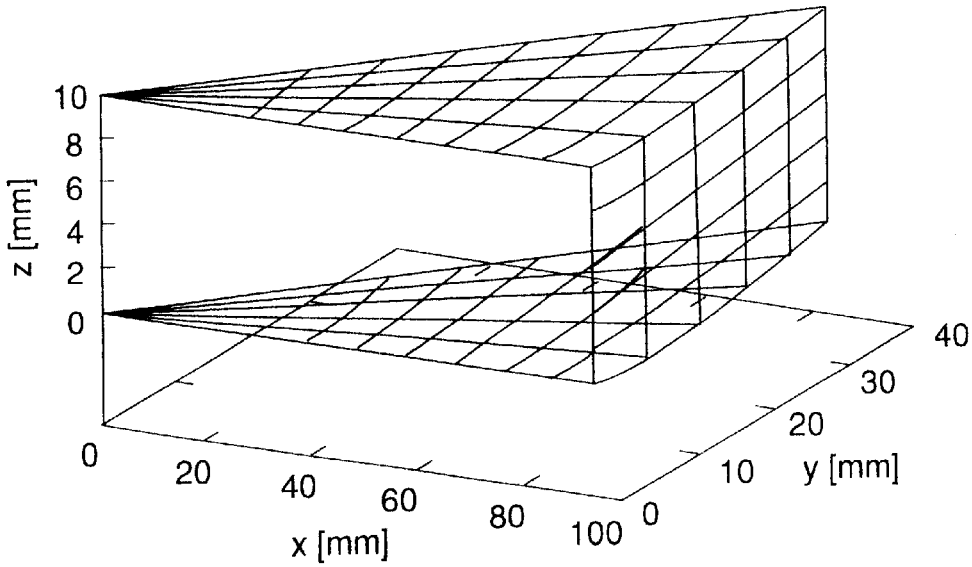
FIG. 7 is a view showing an example of boundary element division of the plating bath in FIG. 5.
Figure 8:
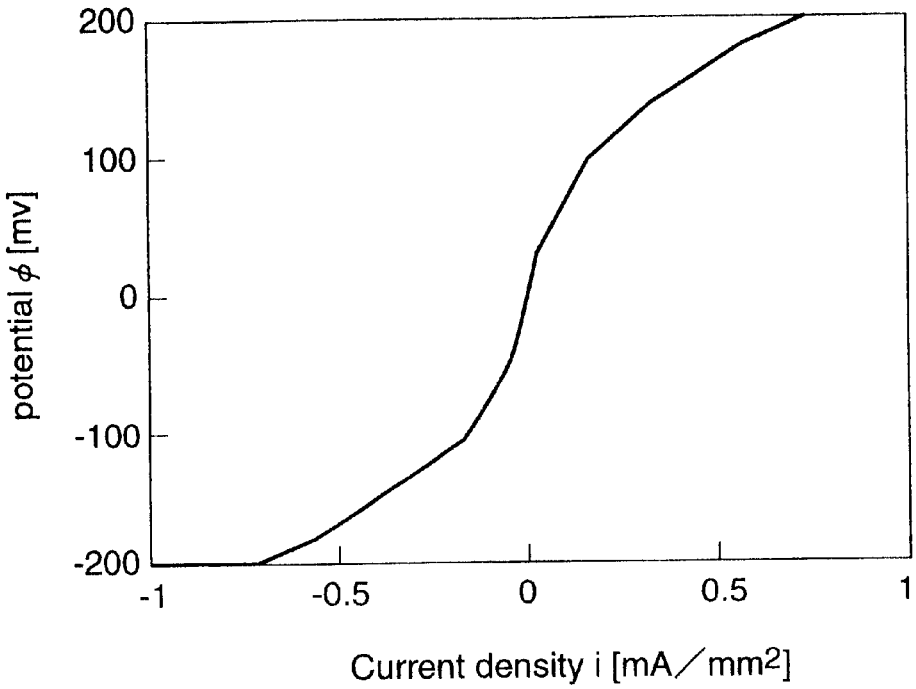
FIG. 8 is a view showing a polarization curve.

On the cathode (silicon wafer), current terminals (−) were connected at equal distances at 8 locations as in FIG. 6. In consideration of symmetry, an analysis region of the plating bath was set to be 1/16 of the entire area, and this region was divided into triangular or quadrilateral constant elements, as shown in FIG. 7. A polarization curve of the anode and the cathode used for the simulation is shown in FIG. 8. A side surface of the plating bath comprised an insulator. Other calculation conditions are as explained in connection with FIG. 5.

Figure 9:
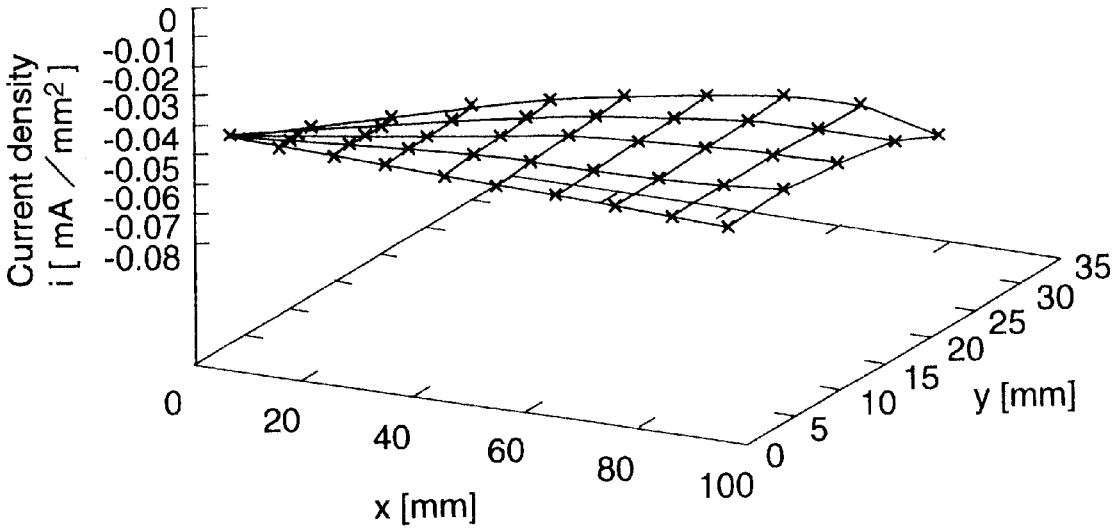
FIG. 9 is a view showing a current density distribution on a cathode (wafer)
Figure 10:
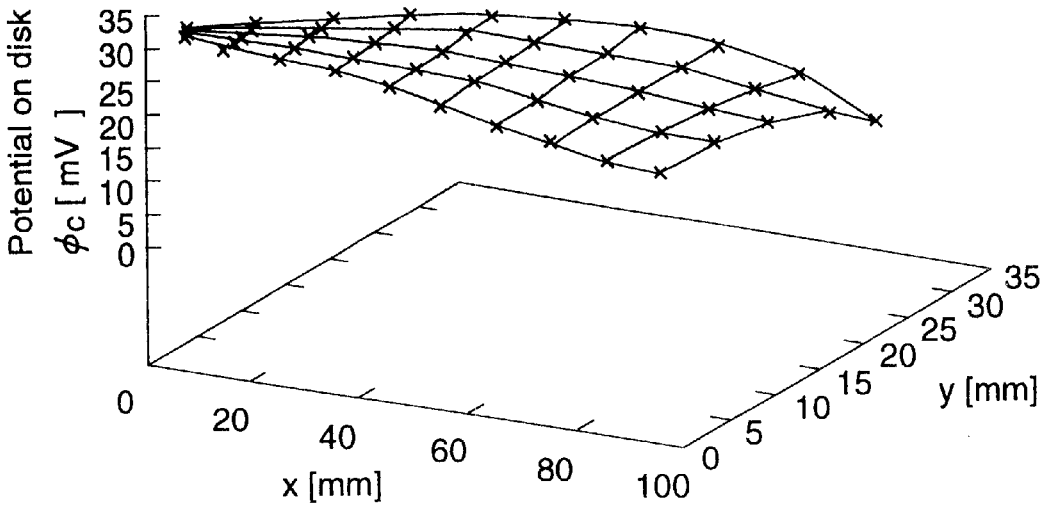
FIG. 10 is a view showing a potential distribution within the cathode (wafer)

FIG. 9 shows the distribution of current density ((−i) is proportional to the plating rate) on the cathode. FIG. 10 shows the distribution of potential within the cathode. If electrical resistance within the cathode is neglected, the potential everywhere within the cathode is zero. Thus, when the electrical resistance within the cathode is considered, the potential distribution leaves zero, becoming nonuniform, as well revealed by the calculation results. In FIGS. 9 and 10, the values at the central points of the elements are connected together and illustrated.

In the above-described embodiments, analysis was performed for a case in which the number of the current terminals (−) on the periphery of the cathode (silicon wafer) was relatively small (8). When this number increases, axial symmetry approximation becomes possible, and the amount of calculation can be decreased. Hence, a method of axial symmetry approximation will be discussed below.

In a field of axial symmetry, the current density ic within the cathode has only a radial component. This component is written as $i^c$ [A/m$^2$]. In a fine annular region at a position of radius r within the cathode, the following relationship holds under the principle of conservation of charge:

$$idS+d(Li^c)=0 \tag{23}$$

where $S=\pi\rho^2$ and $L=2\pi\rho$

When the cathode is radially divided into n-segments to find the difference, the following equation holds in the j-th annulus counted from the interior (hereinafter called the element j):

$$S_j i_j=L_j i^c_j-L_j+1^{i^c}_{j+1} \tag{24}$$

where $$S_j=\pi(\rho^2_{j+1}-\rho^2_j) \tag{25}$$

$$L_j=2\pi 92_j \tag{26}$$

Substitution of Equations (25) and (26) into Equation (24), followed by rearrangement with $\rho_j=0$ and $i^c_1$ considered, gives the following equation:

$$i^c_k=\frac{1}{2\rho_j}\sum_{\kappa=1}^{j-1}(\rho^2_\kappa-\rho^2_{\kappa+1})i_\kappa \quad (j=2,\ldots,n+1) \tag{27}$$

This relationship is matrix represented as $$\{i^c\}_c=[E]\{i\}_c \tag{28}$$

where $\{\ \}_c$ is as defined in connection with Equation (15).

In the field of axial symmetry, the current flows only in the radial direction. Thus, an equation corresponding to Equation (7) is as follows:

$$i_c=-(t_c\kappa_s+t_p\kappa_p)d\phi_c/dr \tag{29}$$

Discretization of this equation gives $$\phi_{c,j}=\frac{1}{2(t_s\kappa_s+t_p\kappa_p)}\sum_{\kappa=j}^{n}(\lambda_{\kappa+1}-\gamma_\kappa)(i^c_\kappa+i^c_{\kappa+1}) \quad (j=1,\ldots,n) \tag{30}$$

where the potential at $\gamma_{n+1}$=R (R: radius of the cathode) was a basis. That is, $\phi_{c,\,n+1}=0$.

When constant elements are used in analyzing the potential and current density in the plating bath, the potential at the center of the element on the cathode needs to be found. If the cathode potential in the center of the element j is defined as $$\phi^o_{c,j}=(\phi_{c,j}+\phi_{c,j+1})/2$$

the following equation is obtained from Equation (30):

$$\{\phi^o_c\}_c=[D]\{i_c\}_c \tag{31}$$

The respective elements of the matrix [D] are easily found from Equation (30). From Equations (28) and (31), $$\{\phi^o_c\}_c=[D][E]\{i\}_c \tag{32}$$

This equation corresponds to Equation (21). Thus, the cathode is divided into elements by use of axially symmetrical elements, and processed according to the above-mentioned calculation procedure, whereby the axial symmetry problem can be solved.

To verify Equation (32), the same case as stated above was set up, and $\{\phi^o_c\}$ of Equation (32) was found by the difference method. The resulting solutions were compared with the analysis solutions (Equation (22)). The results are shown in FIG. 4 (indicated by closed circles in the drawing). Both types of solutions can be confirmed to be consistent highly. According to the difference method, calculations are made, with the cathode being divided radially into 20 segments.

In order to apply a uniform plated film to a cathode, the practice of dividing an anode and giving a different, optimal currents to the resulting divisional anodes will be discussed. To handle this case as an axial symmetry problem, the anode is divided into N segments in the form of concentric circles (doughnuts). For simplification, a constant current density is given to each divisional anode. (If the size of each divisional anode is not so large, such approximation is presumed not to cause a great error.)

As design variables for the present optimization problem, current densities to be given to the divisional anodes are termed $i_{o,j}$ (j=1, . . . , N). The objective function herein is the sum of the squares of the differences from the mean i' of current densities (proportional to the plating rate) flowing into the respective boundary elements on the cathode as shown by the following equation:

$$F(i_{0,1}, i_{0,2}, \ldots, i_{0,N}) = \sum_{j=1}^{m} (i_j - \bar{i})^2 \tag{34}$$

where m is the number of the elements on the cathode surface. Thus, the present optimization problem boils down to finding $i_{o,j}$ (i=1, . . . , N) which minimizes the objective functional equation (34). Total current amount I is designated to be constant ($I_o$), so that the following relationship exists among the respective design variables. Thus, the number of the independent design variables is N−1.

$$i_{o,1}A_1+i_{o,2}A2+\ldots i_{o,N}A_N=I_o \tag{35}$$

where $A_\kappa$ is the area of the divisional anode κ.

Figure 11:
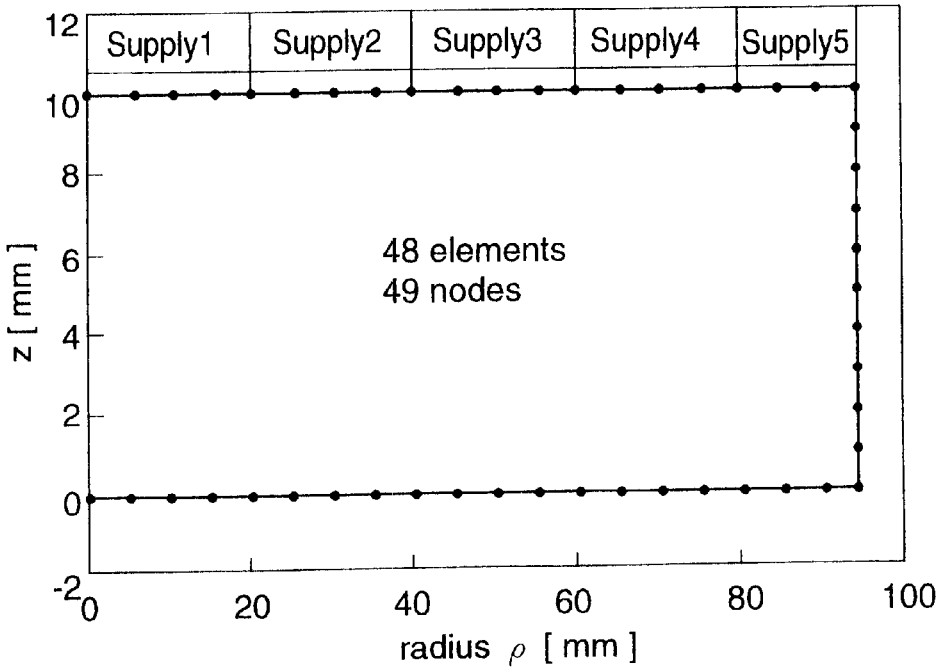
FIG. 11 is a view showing an example of division of an anode.
Figure 12:
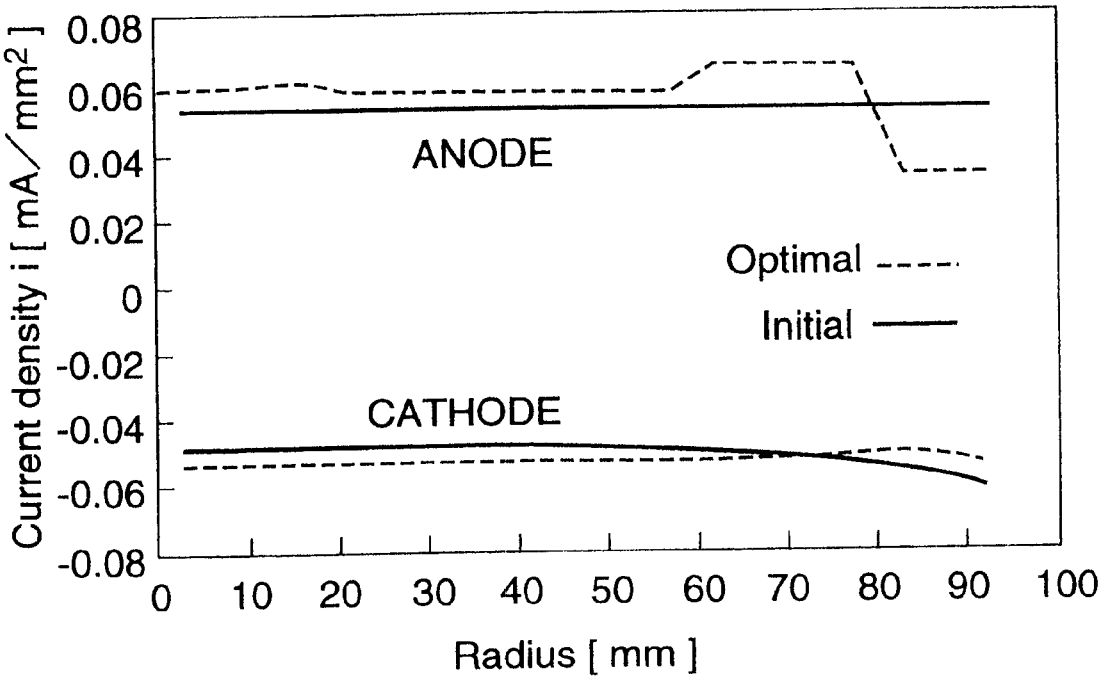
FIG. 12 is a view showing current density distributions on the anode and the cathode before and after optimization.

A similar axis symmetry problem was assumed, with current terminals (−) being put on the entire periphery of an anode, and optimization of a current density distribution was performed, with the anode being divided into 5 segments, as shown in FIG. 11. FIG. 12 shows the current density distributions on the anode surface and the cathode surface before and after optimization. After optimization, the current density distribution on the cathode surface was found to be uniform compared with that before optimization. The Simplex method was used for minimizing the objective function.

The method of regarding the surface of a member to be plated, and an anode as flat surfaces, and discretizing a two-dimensional Poisson's equation by the boundary element method has been described above. If the surface of the member to be plated, and/or the anode are (or is) curved surfaces, the Poisson's equation, the dominant equation, needs to be discretized by the finite element method. A method for analysis will be described below.

An equation satisfying potential within the resistor Ω (2D) on the drawing is $$div_2(\kappa grad_2\phi)+i_s=0 \tag{36}$$

where

κ: Electrical conductivity [$\Omega^{-1}$] of resistor is: Current density [A/m$^2$] flowing into plating solution Ω

$div_2$, $grad_2$: Differential operators defined in plating solution Ω

Kalarkin equation for Equation (36) is:

$$\int_\omega (div_2(\kappa grad_2\phi)+i_{3,})\psi d\Omega= \tag{37}$$

where Ψ is a test function.

Equation (37) is subjected to integration by parts to give $$\int_\Omega (div_2(\kappa grad_2\phi)+i_s)\psi\, d\Omega = \int (\kappa grad_2\phi\cdot n)\psi\, d\Omega - \int_{\Omega\kappa} gard_2\phi\cdot grad_2\psi\, d\Omega + \int_\Omega i_s\psi\, d\Omega = 0 \tag{38}$$

Ω is divided into elements, and φ within the element e is approximated by interpolation function $Ne^i$ as follows:

$$\phi = \sum_\kappa Ne^i\phi_i \tag{39}$$

The interior of the plating solution is dominated by the following Laplace's equation:

$$\nabla_3{}^2\phi=0(i=k_s\nabla\phi) \quad ①$$

where the subscript 3 to ∇ signifies a three-dimension.

The interior of the cathode (silicon wafer) is dominated by the following Poisson's equation:

$$\nabla_2(K(T)\nabla\phi_\omega)+i_\omega=0 \quad ②$$

The interface is defined by:

$$-(\phi-\phi_\omega)=f_\omega(-i_\omega) \quad ③$$

$$i_\omega+i=0 \quad ④$$

The side is defined by:

$$i=0 \quad ⑤$$

Equation ① is discretized by the boundary element method, Equation ② is discretized by the finite element method, and the boundary conditions and connection conditions ③, ④ and ⑤ are considered to formulate a simultaneous equation. Solving this equation by the Newton method gives a current density distribution $i_\omega$ and a potential distribution $\phi_\omega$ as solutions.

According to this method, there can be provided an analysis method which is effective when the surface of the member to be plated and/or the anode are/is a curved surface, or when the inner surface of a hole or groove is to be plated.

Next, a modified embodiment of the present invention will be described. The modified invention is a plating analysis method which comprises giving Poisson's equation, as a dominant equation, to a region within an electrode and/or a member to be plated, with the electrical conductivity or resistance of the electrode and/or the member to be plated being used as a function of time, or as a function of the thickness of the electrode and/or the member to be plated; discretizing the equation by the finite element method; and formulating a simultaneous equation of the discretized equations to find changes in the plating thickness over time.

As an example, consider copper plating for constructing copper wiring on a wafer as stated earlier. When plating is initiated, the thickness of the cathode varies with the passage of time. As a result, a two-dimensional distribution of the resistance or electrical conductivity within the region of the cathode becomes nonuniform. Thus, the resistance or electrical conductivity within each portion of the cathode region is handled as a function of time, and calculations are repeated at certain time intervals, whereby changes in the plating thickness over time can be determined. For the region of the plating solution within the plating bath of a complicated shape, the time required for division into elements and for calculations can be shortened to perform efficient analysis, because the dominant equation is discretized by the boundary element method.

The analysis method as the modified embodiment of the invention will be described briefly below.

The potential distribution within the plating solution is dominated by the three-dimensional Laplace's equation ①. The dominant equation for the electrode and/or the member to be plated is the two-dimensional Poisson's equation ②. The boundary condition for the interface between the electrode and/or the member to be plated and the plating solution is the polarization curve of the electrode and/or the member to be plated, and is generally expressed by the equation ③. Provided that the current (−i) flows from the plating solution into the surface of the cathode, the equation ④ is obtained according to the principle of conservation of charge in the fine region within the cathode. On the insulating surface, the equation ⑤ holds.

Equation ① is discretized by the boundary element method, Equation ② is discretized by the finite element method, and the boundary conditions and connection conditions ③, ④ and ⑤ are considered to formulate a simultaneous equation. Solving this equation by the Newton-Raphson method gives a current density distribution and a potential distribution.

The electrical conductivity κ is a function of the plating thickness T, the plating thickness T is a function of time t, and the above equation is an ordinary differential equation. Thus, it can be solved by methods such as the Euler method and Rungecoota method.

That is, the equation is solved for the current density distribution on the wafer at zero time. Then, the plated film thickness distribution after a lapse of a certain time is calculated. From this plated film thickness, the current density distribution on the wafer is found again, and the film thickness distribution after a lapse of a subsequent constant time is calculated. By repeating such calculations, the plated film thickness distribution after a predetermined time can be found.

In the case of a wafer as an electrode having a flat surface, the dominant equation for the interior of the electrode is a two-dimensional Poisson's equation. If the surface of the member to be plated is three-dimensional, the dominant equation is a three-dimensional Poisson's equation. In this manner, analysis is carried out.

Another modified embodiment of the invention is a plating analysis method for electroplating in a system in which resistance of an electrode and/or a member to be plated cannot be neglected, the method comprising dividing an anode into two or more divisional anodes; giving a three-dimensional Laplace's equation as a dominant equation to a region containing a plating solution; giving a two-dimensional Poisson's equation dealing with a flat surface or a curved surface as a dominant equation to a region within the electrode and/or the member to be plated; discretizing the equations by the boundary element method; formulating a simultaneous equation based on the results to calculate such optimum values of a current flowing through the divisional anodes as to uniformize a current density distribution on the surface of the cathode; and giving the optimum values of current to uniformize the plating rate.

Figure 1A:
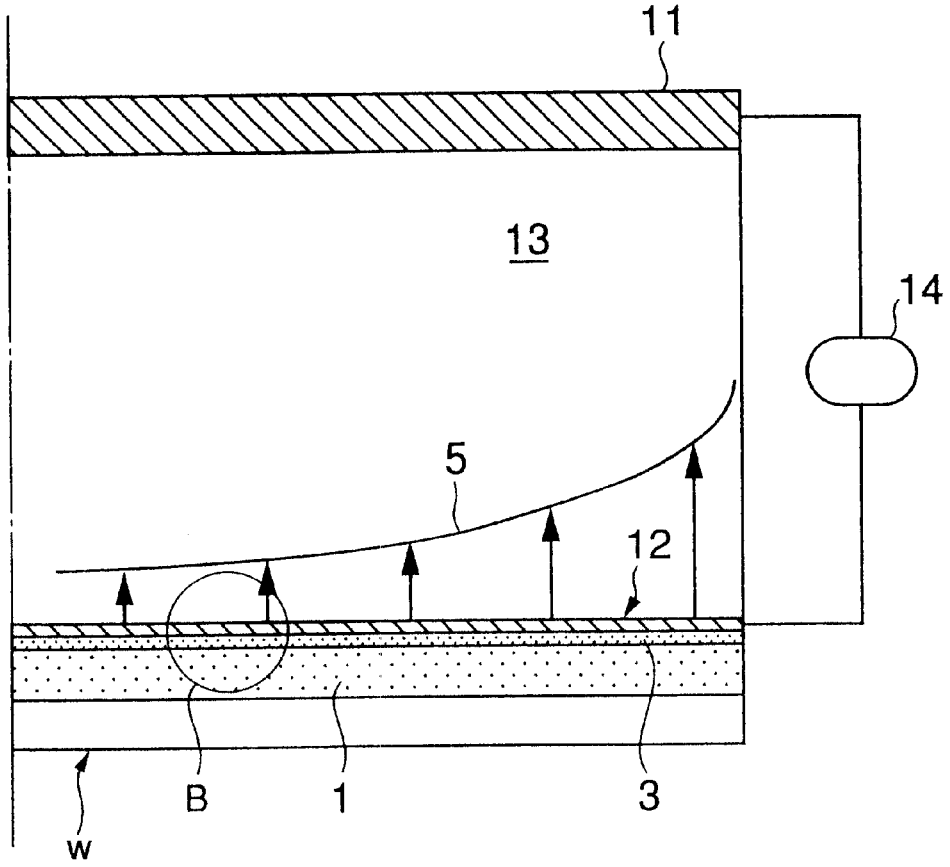
FIG. 1A is a view showing a model of a plating to be analyzed.
Figure 1B:
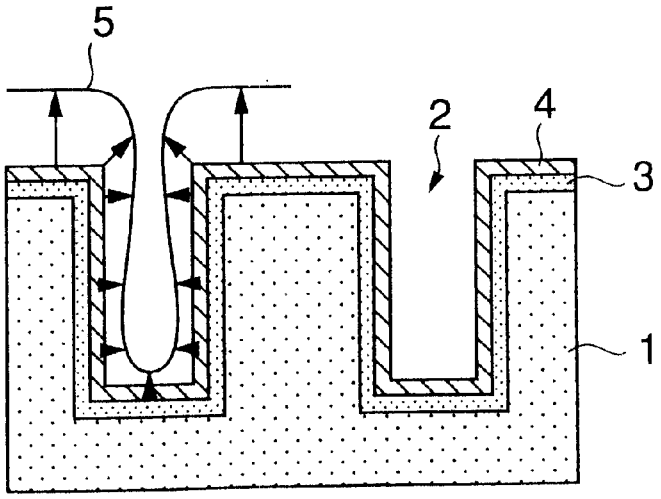
FIG. 1B is an enlarged view of a B portion in FIG. 1A.

In a plating bath as shown in FIG. 1, because of the resistance of a cathode (a wafer to be plated), the current density on the inner peripheral side of the wafer is suppressed to cause a nonuniform thickness of plating, i.e., thick on the outer peripheral side and thin on the inner peripheral side. Thus, an anode is divided in a concentrically circular form, and a high current density is given to the divisional anodes on the inner peripheral side, whereby the current density on the cathode surface can be made uniform. To find the optimal values of a current given to the divisional anodes for uniformization of the plating thickness, it is necessary to adopt numerical analysis. The numerical analysis is based on the methods of the above-described embodiments, and is performed by optimization.

Still another modified embodiment of the invention is a plating analysis method for electroplating in a system in which resistance of an electrode and/or a member to be plated cannot be neglected, the method comprising dividing an anode into two or more divisional anodes; giving a three-dimensional Laplace's equation as a dominant equation to a region containing a plating solution; discretizing the equation by the boundary element method; giving a two-dimensional Poisson's equation dealing with a flat surface or a curved surface as a dominant equation to a region within the electrode and/or the member to be plated, with the electrical conductivity or resistance of the electrode and/or the member to be plated being used as a function of time or as a function of the thickness of the electrode and/or the member to be plated; discretizing the equation by the boundary element method or the finite element method; formulating a simultaneous equation based on the results; and calculating and giving, at time intervals, such optimum values of a current flowing through the divisional anodes as to uniformize a current density distribution on the surface of the cathode, thereby uniformizing the plating rate.

In each of the foregoing aspects of the invention, analysis is done on the premise that the cathode resistance is uniform initially (at zero time). After a lapse of a certain time, however, the plating thickness increases as a whole, and the cathode resistance decreases overall. Thus, there must be a difference between the optimal current distribution of the divisional anodes at zero time and the optimal current distribution of the divisional anodes after a certain time. It is therefore necessary that the resistance of the cathode be varied over time according to a time-varying increase in the plating thickness, and an optimal current distribution of the divisional anodes at time intervals be imparted. When the optimal current distribution of the divisional anodes is varied and given so as to uniformize the current density distribution of the cathode constantly, the resistance on the cathode surface is uniform, so that the boundary element method may be given for discretization of the dominant equation for the cathode. On the other hand, when the current distribution of the divisional anodes is varied at certain time intervals, non uniformity of the plating thickness of the cathode occurs after the certain time. In recalculating the optimal current distribution of the divisional anodes while considering this non uniformity of the plating thickness of the cathode, it is necessary to apply the finite element method for discretization of the dominant equation for the cathode.

According to the above-mentioned embodiments, geometry of the anode and the cathode (wafer to be plated) is given, whereby current density and potential distributions can be determined in consideration of a resistant component, if any, of the anode and/or the cathode. Plating of the wafer by use of this analysis method can result in a highly uniform plating. In designing the plating bath, moreover, optimum parameters can be obtained without the need to repeat experimental trials and errors.

The above explanations have been offered mainly for examples of copper plating on a semiconductor wafer. However, the present invention, of course, can be widely used for precision plating of satisfactory plane uniformity on a thick substrate having a resistant component. Furthermore, the principle of the present invention is applicable not only to a method for analysis of plating, but also to a method for analysis of corrosion and corrosion prevention of a metal. That is, if a member to become an anode or a cathode has a resistant component in buried pipes or various instruments disposed in water or the ground, it becomes possible to analyze a current density distribution and a potential distribution efficiently in consideration of the resistant component.

While the present invention has been described in the foregoing fashion, it is to be understood that the invention is not limited thereby, but may be varied in many other ways. Such variations are not to be regarded as a departure from the spirit and scope of the invention, and all such modifications as would be obvious to one skilled in the art are intended to be included within the scope of the appended claims.

What is claimed is:

1. A plating analysis method for electroplating in a system, comprising:

giving a three-dimensional Laplace's equation, as a dominant equation, to a region containing a plating solution between an anode and a cathode;

discretizing the Laplace's equation by a boundary element method;

giving a two-dimensional or three-dimensional Poisson's equation dealing with a flat surface or a curved surface, as a dominant equation, to a region within the anode and/or the cathode;

discretizing the Poisson's equation by the boundary element method or a finite element method; and formulating a simultaneous equation of the discretized equations to calculate a current density distribution and a potential distribution in the system.

2. The plating analysis method of claim 1, further comprising:

giving electrical conductivity or resistance of the anode and/or the cathode, as a function of time, to the region within the anode and/or the cathode.

3. The plating analysis method of claim 1, further comprising:

dividing the anode into two or more divisional anodes; and calculating such optimum values of current flowing through the divisional anodes as to uniformize a current density distribution on a surface of the cathode, thereby uniformizing a plating rate.

4. The plating analysis method of claim 3, further comprising:

calculating and giving the optimum values of current flowing through the divisional anodes at time intervals, thereby uniformizing the plating rate.

5. A plating apparatus produced with use of the plating analysis method claimed in claim 1.

6. The plating apparatus of claim 5, wherein a position, a shape, and a size of the anode and/or a position, a shape and a size of a shield plate have been adjusted so that the current density distribution on the surface of the cathode will be uniformized by use of the plating analysis method claimed in claim 1.

7. A plating method comprising:

applying a metal plating by use of the plating analysis method claimed in claim 1, the metal plating being intended for formation of wiring on a wafer for production of a semiconductor device.

8. A method for producing a wafer for a semiconductor device, comprising:

applying plating to the wafer by the plating method of claim 7; and polishing a surface of the wafer by chemical and mechanical polishing (CMP) to produce the wafer of a desired wiring structure.

9. A method for analysis of corrosion and corrosion prevention in a system, comprising:

giving a three-dimensional Laplace's equation, as a dominant equation, to a region containing an electrolyte;

discretizing the Laplace's equation by a boundary element method;

giving a two-dimensional or three-dimensional Poisson's equation dealing with a flat surface or a curved surface, as a dominant equation, to a region within the anode and/or the cathode;

discretizing the Poisson's equation by the boundary element method or a finite element method; and formulating a simultaneous equation of the discretized equations to calculate a current density distribution and a potential distribution in the system.

* * * * *